US008038502B2

(12) United States Patent
Loetz

(10) Patent No.: US 8,038,502 B2
(45) Date of Patent: Oct. 18, 2011

(54) TOY FIGURES, PLAY SET, AND PLAY SET ACCESSORIES

(75) Inventor: Lee Ronald Loetz, Valley Village, CA (US)

(73) Assignee: Disney Enterprises, Inc., Burbank, CA (US)

( * ) Notice: Subject to any disclaimer, the term of this patent is extended or adjusted under 35 U.S.C. 154(b) by 186 days.

(21) Appl. No.: 11/162,347

(22) Filed: Sep. 7, 2005

(65) Prior Publication Data

US 2007/0054589 A1 Mar. 8, 2007

(51) Int. Cl.
*A63H 33/06* (2006.01)

(52) U.S. Cl. ..... 446/118; 446/129; 446/92; 446/268; 446/376

(58) Field of Classification Search ..... 446/118, 446/128, 129, 137, 92, 376, 268; 273/239, 273/282.1, 260
See application file for complete search history.

(56) References Cited

U.S. PATENT DOCUMENTS

| | | | | |
|---|---|---|---|---|
| 171,533 | A | 12/1875 | Schmetzer | |
| 172,709 | A | 1/1876 | Crandall | |
| 3,222,068 | A | 12/1965 | Cowels | |
| 3,672,674 | A | 6/1972 | Reed | |
| 3,745,698 | A * | 7/1973 | Davidson | 446/129 |
| 3,757,467 | A | 9/1973 | Von Winckelmann | |
| 3,849,930 | A * | 11/1974 | Stubbmann | 446/137 |
| 3,946,520 | A | 3/1976 | Goldfarb et al. | |
| 4,118,888 | A | 10/1978 | Ogawa | |
| 4,150,828 | A * | 4/1979 | Marchese | 273/260 |
| 4,154,019 | A | 5/1979 | Neuhierl | |
| 4,203,248 | A | 5/1980 | Tapdrup | |
| 4,233,778 | A | 11/1980 | Lemelson | |
| 4,349,984 | A * | 9/1982 | Goldfarb et al. | 446/93 |
| 4,515,371 | A * | 5/1985 | Basevi | 273/260 |
| 4,699,385 | A * | 10/1987 | Bifulco | 273/260 |
| 4,861,039 | A | 8/1989 | Phillips et al. | |
| 4,861,308 | A * | 8/1989 | Kakizaki | 446/129 |
| 5,286,030 | A * | 2/1994 | Villagomez | 273/242 |
| 5,759,082 | A * | 6/1998 | Kujawski et al. | 446/139 |
| 5,848,788 | A * | 12/1998 | Hess | 273/239 |
| 6,056,619 | A | 5/2000 | Wiggs et al. | |
| 6,179,685 | B1 | 1/2001 | Toft | |
| 6,575,810 | B1 * | 6/2003 | Sohn | 446/485 |
| 6,893,315 | B2 * | 5/2005 | Barri | 446/92 |
| 2002/0115376 | A1 * | 8/2002 | Whitehead | 446/376 |
| 2003/0228825 | A1 | 12/2003 | Whitehead | |

FOREIGN PATENT DOCUMENTS

GB 2032785 A * 5/1980

* cited by examiner

*Primary Examiner* — Gene Kim
*Assistant Examiner* — Urszula M Cegielnik
(74) *Attorney, Agent, or Firm* — Ference & Associates LLC

(57) ABSTRACT

The disclosure relates to toy figures, corresponding play sets and play set accessories. In particular, the toy figures have a body portion comprising at least two articulated appendages and a magnetic base portion disposed at the bottom of the body portion, wherein the magnetic base portion has a distinct shape permitting the magnetic base portion to be detachably coupled with a recess of compatible shape. Additionally, corresponding play set and play set accessories can have magnetic, distinctly shaped recesses for receiving the particular distinctly shaped base of the toy figure. Thus, the magnetic base portion and the recess of a play set or play set accessory have essentially the same distinct shape.

7 Claims, 8 Drawing Sheets

TOY FIGURES, PLAY SET, AND PLAY SET ACCESSORIES

BACKGROUND

1. Field

This disclosure relates to toy figures and corresponding toy play sets and play set accessories. In particular, it relates to toy figures with articulated appendages and a distinctly-shaped, magnetic base.

2. General Background

Toy figures with articulated limbs are generally known. Toy figures with magnetic bottoms and accompanying magnetic play sets are also known. In particular, many of these magnetically operable play sets and toy figures are magnetically attracted to each other so that the movement of a particular piece causes the toy figure to move. Furthermore, magnets have been utilized in the toy industry for such purposes as adhering magnetizable members to a structure. Other toy figures have a magnetic bottom and magnetic play set where the toy figures are magnetically held to the play set. Additionally, the prior art includes toy figures with a play set and play set accessories where the toy figure can connect to or fit within a corresponding peg or recess of a play set or play set accessory.

Although these features are found in the toy industry, the prior art has so far failed to combine a toy figure with different magnetic distinctly-shaped bases and with corresponding play set and play set accessories.

SUMMARY

The invention relates to toy figures, corresponding play sets and play set accessories. In particular, the toy figures may have articulated appendages and a magnetic distinctly shaped base. Furthermore, the distinct shape of the base may be a geometric shape or other irregular shape. Additionally, the corresponding play set and play set accessories have magnetic recesses shaped for receiving the particular geometrically-shaped base of the toy figure.

In one aspect, the toy figure comprises a body portion comprising at least one articulated appendage or member. Furthermore, the toy figure also comprises a base portion connected to the distal end of an articulated appendage. The base portion can have a distinct shape permitting the base portion to be detachably coupled with a recess, wherein the recess has a shape compatible with the distinct shape of the base portion. The base portion can be made of magnetic material such that the base portion and the recess are attracted magnetically.

In another aspect, the base portion can protrude from the body of the toy, such that base portion can be at least partially inserted in the recess. The base portion can have a distinctly shaped contour permitting the base portion to be inserted or coupled with the recess having a contour of essentially the same shape.

In another aspect, the toy figure is in the form of a person, animal, fictitious character, cartoon character, or fictitious creature. In another aspect, the distinct shape of the recess, the base portion, or the contour of the base portion has a distinct shape. The distinct shape can be the shape of a circle, an oval, a square, a rectangle, a triangle, a star, a heart, a rhombus, a number, a letter, a common symbol, a mathematical operator, or a famous cartoon character's shape that is easily recognizable by children.

In another aspect, the magnetic base portion is compatible with the recess, wherein the recess is disposed on a play set or play set accessory, and wherein the magnetic base portion and the recess of a play set or play set accessory have essentially the same distinct shape. The magnetic base portion and the recess of a play set or play set accessory can be magnetically connected.

In one aspect, there is a toy play set comprising a support portion having at least one magnetic recess, the at least one magnetic recess configured to be distinctly shaped. The toy play set also includes at least one toy figure having a body portion and a magnetic base portion, the body portion comprising at least one articulated appendage and wherein said magnetic base portion is essentially distinctly shaped. The distinctly shaped base portion of a toy figure and said distinctly shaped recess of said toy play set are essentially the same distinct shape and are magnetically attracted to each other.

In another aspect, numerous types of play sets are provided where the play set has at least one geometrically-shaped magnetic recess. In one embodiment, the play set can include two receptacles each having a floor, three walls and a ceiling, and connected to each other by at least one hinge. The hinge allows the user to fold open and fold close the receptacles. The first and second receptacles have essentially the same width and height. Thus, when the receptacles are folded in a closed position, the receptacles form a case. Additionally, the receptacles may be folded in a completely open position, where the receptacles are in an essentially one-hundred-and-eighty-degree plane. Of course, the user may position the receptacles in a range of various positions, creating many different angles between the receptacles.

In another aspect, a toy play set accessory having a second magnetic recess located on a surface area of said toy play set accessory is provided in the play set. The second magnetic recess of said toy play set accessory is essentially distinctly shaped, and wherein the magnetic base portion of a toy figure and the second recess are essentially the same distinct shape and are magnetically attracted to each other. The toy play set accessory is in the form of furniture, vehicle, appliance, animal, equipment, or décor.

In one aspect, there is a toy play set comprising a base portion having a plurality of magnetic recesses, wherein each magnetic recess in the plurality of magnetic recesses is configured as a distinct shape. The toy play set comprises a plurality of toy figures each having a body portion and a magnetic base portion, said body portion comprising at least two articulated appendages and wherein each magnetic base portion is configured as a distinct shape. At least one toy of the plurality of toys has a magnetic base portion with a shape that uniquely corresponds to at least one similar distinctly shaped recess from the plurality of magnetic recesses.

In yet another aspect, a toy figure comprises a body portion and a base portion. The body portion comprises a first articulated leg and a second articulated leg. The base portion comprised of a first subcomponent and a second subcomponent, wherein the first subcomponent complements the second subcomponent to form a distinct shape. The first subcomponent can be connected to the distal of the end of the first articulated leg, and the second subcomponent can be connected to the distal end of the second articulated leg. The base portion can be detachably coupled with a recess, wherein the recess has a compatible shape with the distinct shape of the base portion. The base portion can be made of magnetic material such that the base portion and the recess are attracted magnetically.

DRAWINGS

The above-mentioned features and objects of the present disclosure will become more apparent with reference to the following description taken in conjunction with the accompanying drawings wherein like reference numerals denote like elements and in which:

FIG. 1*a* illustrates a front view of a toy figure in a standing position.

FIG. 1*b* illustrates a side view of a toy figure in a seated position.

FIGS. 1*c*-1*e* illustrate bottom perspective views of a toy figure with a distinctly shaped base and a corresponding distinctly shaped recess.

FIG. 1*f* illustrates a front view of a toy figure in a standing position.

FIGS. 1*g*-1*h* illustrate different embodiments of the toy figure standing on one foot.

FIG. 2*a* illustrates a play set in an open position and play set accessories.

FIG. 2*b* illustrates a play set in a closed position and play set accessories.

FIGS. 3*a*-3*e* illustrate different embodiments of the toy figure.

DETAILED DESCRIPTION

The toy figure disclosed herein has one or more appendages and a distinctly-shaped magnetic base portion. Each appendage can be articulated to the toy to allow the appendage to rotate as a joint within its respective socket located in the body of the figure. Furthermore, each appendage is independently articulated from any other appendage. Thus, each of the figure's appendages can be positioned or angled independently. This allows the user of the toy to play with and adjust the toy in various positions. An appendage includes but is not limited to an arm, leg, or tail.

The base portion of each toy is magnetized which allows the user to magnetically secure the toy onto an attracting surface. Further, the base portion of the toy can have a specific shape that allows the user of the toy to retrofit the base portion of the toy onto a recess of similar shape.

Figure 1A:
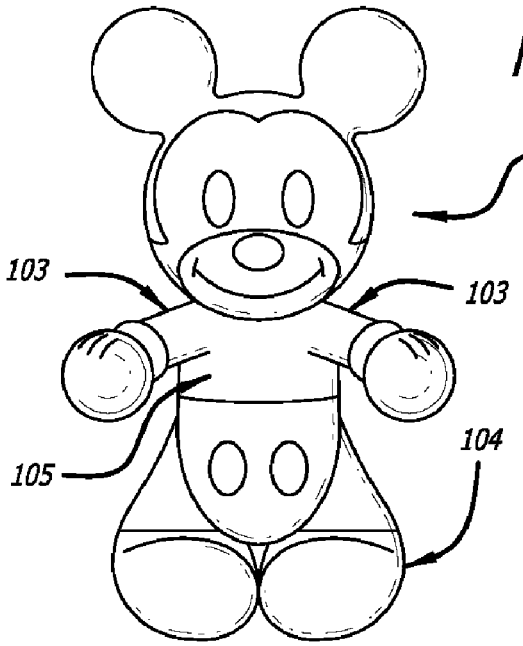

FIG. 1*a* illustrates a front view of a toy figure in a standing position in accordance with one embodiment of the disclosure. The toy figure 100 has a body 105, two articulating arms 103, and two articulating legs 104. As stated above, the toy figure can be configured in numerous positions such as sitting, standing, bending, stretching, raising one arm, raising both arms, etc.

Figure 1B:
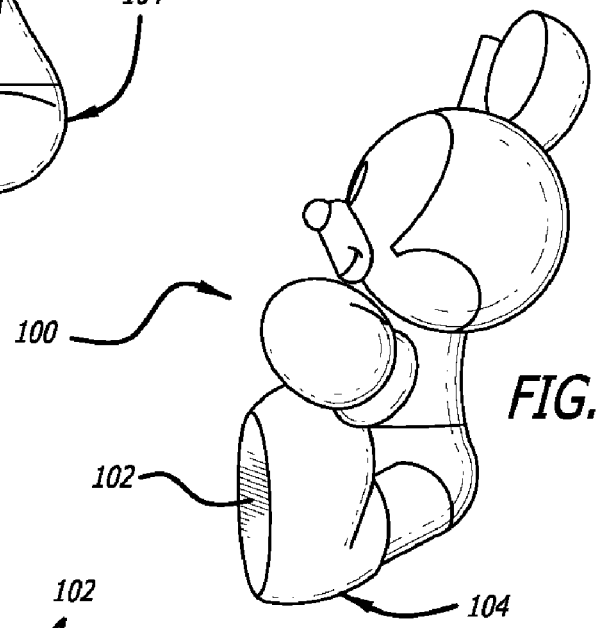

FIG. 1*b* illustrates a side view of a toy figure 100 in a seated position. In one embodiment, a base portion 102 of the toy figure 100 forms an overall distinct shape. The shape of the base portion 102 of the toy figure 100 is shown to be circular. However, the base portion 102 can form any type of distinct shape, whether geometric or not. Such distinct shapes include, but are not limited, to a circle, oval, square, rectangle, heart, triangle, star, or any other shape. Other distinct shapes include, but are not limited to, a particular number, a particular letter, a common symbol, a mathematical operator, or a famous cartoon character's shape that is easily recognizable by children.

In further embodiments, it is contemplated that base portion 102 of the toy figure is magnetic so that the toy figure can stand upright on a surface that attracts the toy using the magnetic field of the base portion 102.

Figure 1C:
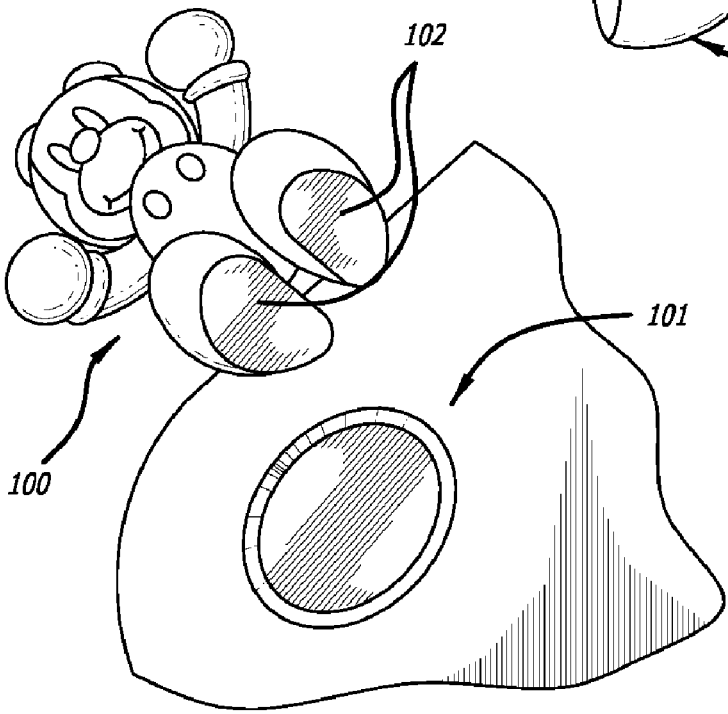
Figure 1D:
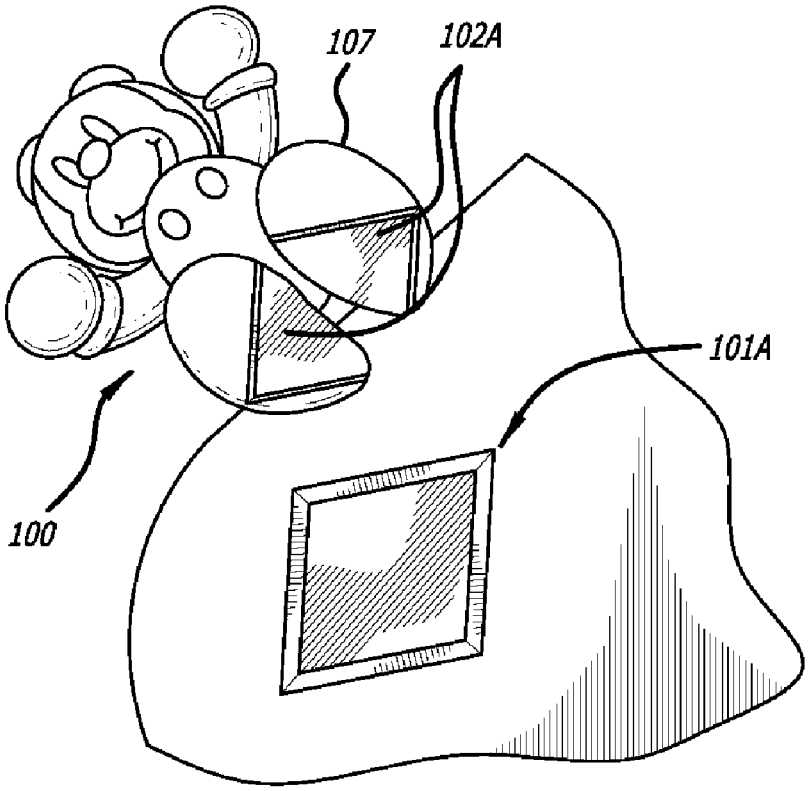
Figure 1E:
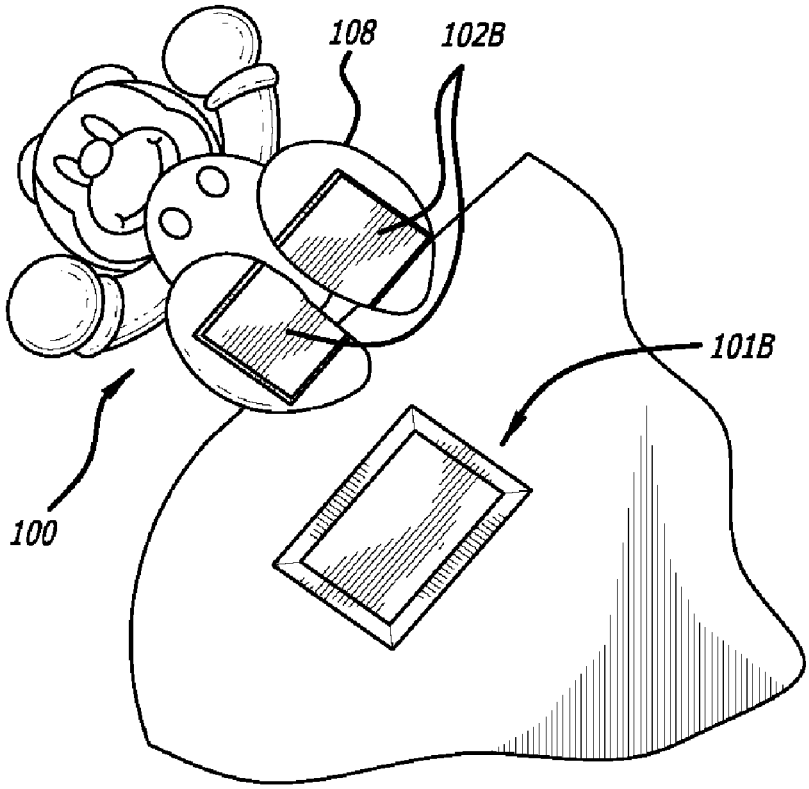

FIGS. 1*c*-1*e* illustrate bottom perspective views of a toy figure with a distinctly shaped base and a corresponding distinctly shaped recess. For exemplary purposes, FIG. 1*c* illustrates a circular-shaped base portion, FIG. 1*d* illustrates a triangular-shaped base portion 102A, and FIG. 1*e* illustrates a square-shaped base portion 102B. Each of these uniquely or distinctly shaped base portions 102, 102A, and 102B have a corresponding recess in which the base portion 101, 101A, and 101B, is respectively coupled. Thus, the base portions and their corresponding recesses allow the user to engage in a shape-sorting activity where the user can match the shape of the base to a corresponding shaped recess in order that the toy figure be compatible and fit within a particular recess. For example, in an embodiment, the play set or play set accessories may include multiple recesses with different shapes. Similarly, there may be multiple toy figures with different shaped base portions. Thus, in order for a toy figure's base portion to fit within a recess, the user must determine and match the shape of the base portion to the shape of the recess.

FIG. 1*c* illustrates a bottom perspective view of a circular base of the toy figure and a corresponding circular shaped recess. The base portion 102 attached to the feet of the toy figure 100 forms an essentially circular shape in keeping with a recess 101 of a surface area also in the form of an essentially circular shape. Because the base portion 102 and the recess portion 101 are in an essentially circular shape of similar dimensions, the toy figure's base portion 102 can be coupled with the recess 101.

The recesses can also have a magnet inside or be made of magnetic material. Thus, the magnetic attraction between the base portion 102 of the toy figure 100 and the recess 101 can guide and assist the user in fitting and holding the toy figure within a recess.

In one embodiment, the base portion 102 further includes at least two subcomponents. Each subcomponent has a specific shape such that when both subcomponents are aligned next to each other or in the same plane, they form one specific and overall shape. For example, one subcomponent of the base portion 102 attached to the left foot of the toy 100 can have a semicircular shape. Likewise, a second subcomponent of the base portion 102 attached to the right foot of the toy 100 can have a semicircular shape. When the two feet are put together, they form an overall circular shape that can be coupled with the recess 101.

FIG. 1*d* illustrates a bottom perspective view of a diamond-shaped base of the toy figure 100 and a corresponding diamond-shaped recess 101A. The recess 101A has a rhomboidal shape. Accordingly, because the toy figure 100 has a rhomboidal base portion 102A, a user may want to place the toy figure 100 into the rhomboidal recess 101A. Each foot 107 of the toy 100 has attached a subcomponent of the base portion 102A. Each subcomponent can have a triangle shape such that when the feet are aligned next to each other or in the same plane, the base portion 102A has an overall rhomboidal shape. The base portion 102 can then mate with the recess 101A which has a rhomboidal shape. Thus, each subcomponent effectively mirrors the subcomponents on the other foot of the toy 100 which allows the user to create a single overall shape. In another embodiment, each subcomponent does not mirror each other, but rather complements each other so as to form a non-symmetrical shape. For example, one component could be the pointed end of a heart shape, while the other subcomponent can be the two rounded portions of the heart shape.

This provides the user with a further shape-sorting and dexterity activity. Meaning, the user can use his or her dexterity to position each foot or leg of the toy figure to create an overall shaped base portion. Then, the user can fit the overall shaped base portion into a corresponding shaped recess.

FIG. 1*e* illustrates a bottom perspective view of a rectangular base of the toy figure and a recess. Each foot 108 of the toy 100 has a subcomponent of the base portion 102B. Each subcomponent has a rectangular shape such that when the feet are aligned next to each other or in the same plane, the base portion 102B has an overall rectangular shape. The base portion 102B can then mate with the recess 101B which has a rectangular shape as well.

Figure 1F:
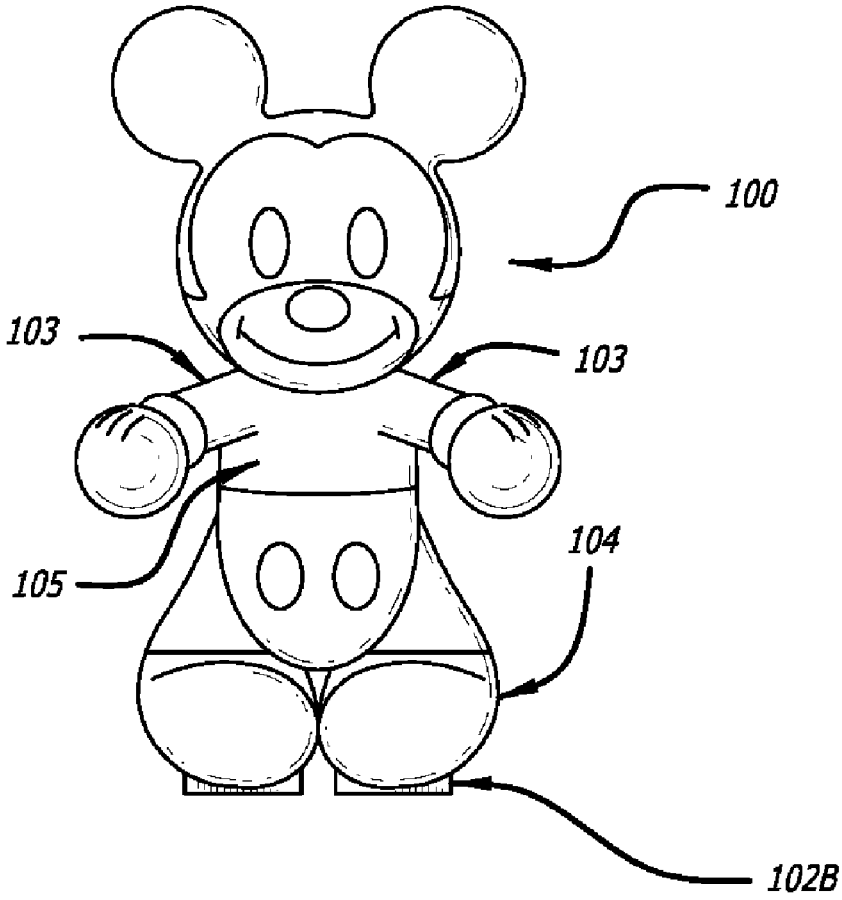

FIG. 1*f* illustrates a front view of a toy figure in a standing position. A raised base portion 102B is shown at the bottom of feet 104 of the toy figure 100. The raised base portion 102B is raised off the surface of the feet 104 to have a predefined thickness. The raised base portion 102B can act as a projecting piece which will fit into a corresponding recess 101B. The recess 101B can have a similar size and depth such that when the raised base portion 102B is placed on top of the recess, the toy 100 can require some pressure to insert base portion 102B into the recess. Thus, the raised base portion 102B can enable the toy figure to better fit within a corresponding recess and allow the toy 100 to be more stable in relation to the recess. The depth and size of the raised base portion 102B and corresponding recess portion can vary.

In another embodiment, the base portion is not raised, but the feet or legs of the toy figure itself form a particular shape. With the feet having a certain configuration, a corresponding recess can also be provided so that the actual foot of the toy 100 is inserted in the recess.

Figure 1G:
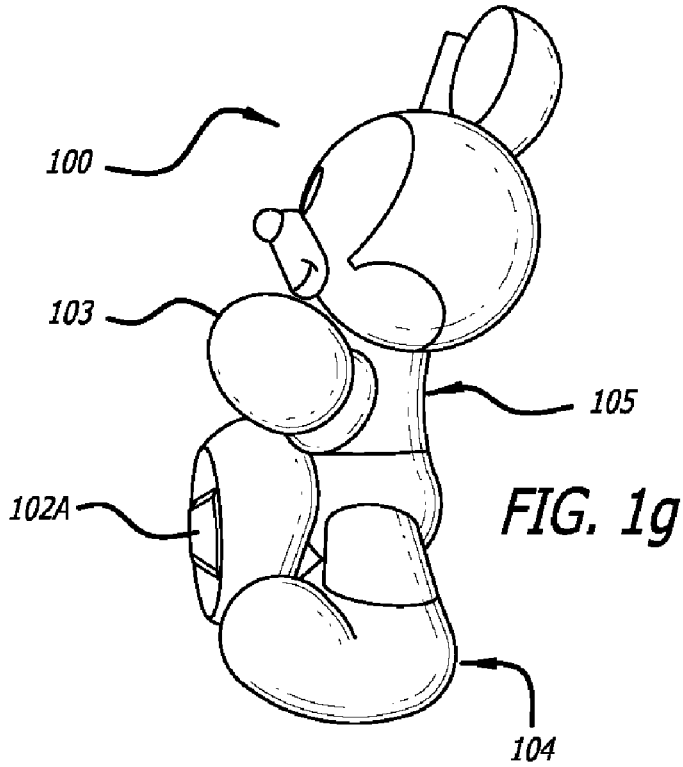
Figure 1H:
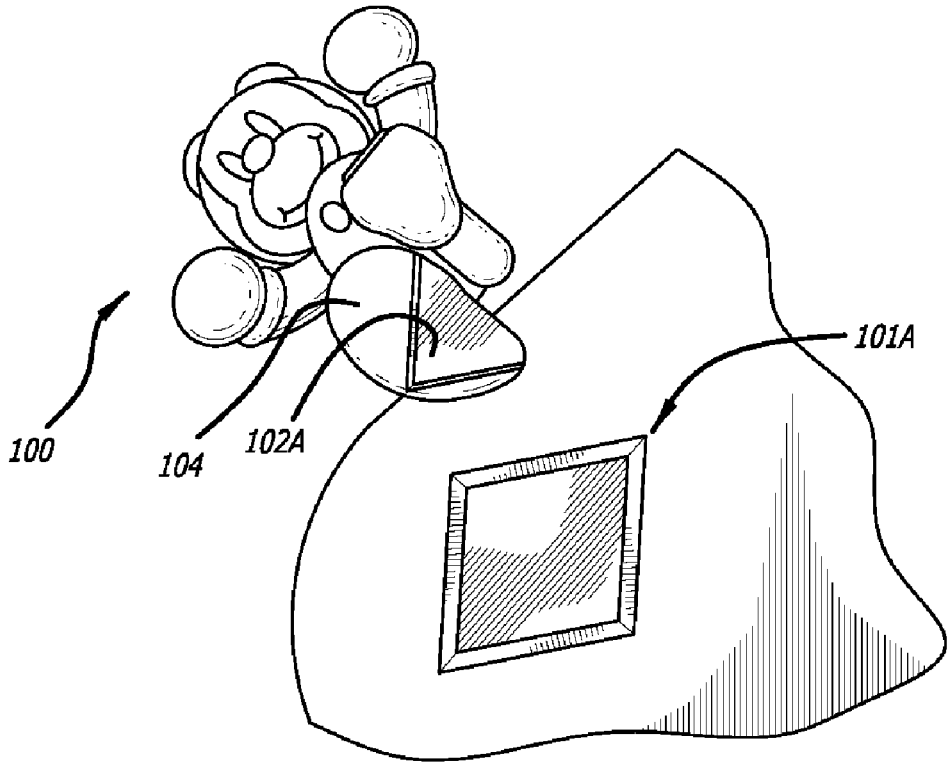

FIGS. 1*g*-1*h* illustrate different embodiments of the toy figure standing on one foot. As mentioned above, the toy figure 100 is articulated at each appendage. Thus, the toy 100 can be configured in numerous positions and not limited to a sitting or standing position.

In one embodiment, one leg of the toy figure 100 is positioned to be at a ninety-degree angle with respect to the body of the toy figure 100, and the other leg remains straight. In this configuration, the user can position the toy 100 on a recess that matches the shape on the component of the base portion 102A of the supporting leg. A user can then match the toy with different recesses as the toy is standing on one leg. In general, the variation of the shape of each subcomponent of the base portion 102A allows a user to play with the figure toy 100 by placing the toy figure in different recesses depending on the position of the legs and on the shape of the subcomponent of the base portion 102A. For example, where the subcomponent of the base portion 102A is triangular, the toy 100 can be placed on a triangular recess. Of course, the triangular subcomponent can also be placed on recesses that are larger than the triangle shape of the subcomponent. For example, the triangle-shaped base portion 102A could be placed within the recess 101A, even when the base portion 102A does not provide the fit and the compatibility of a corresponding rhomboidal base portion 102A.

Figure 2A:
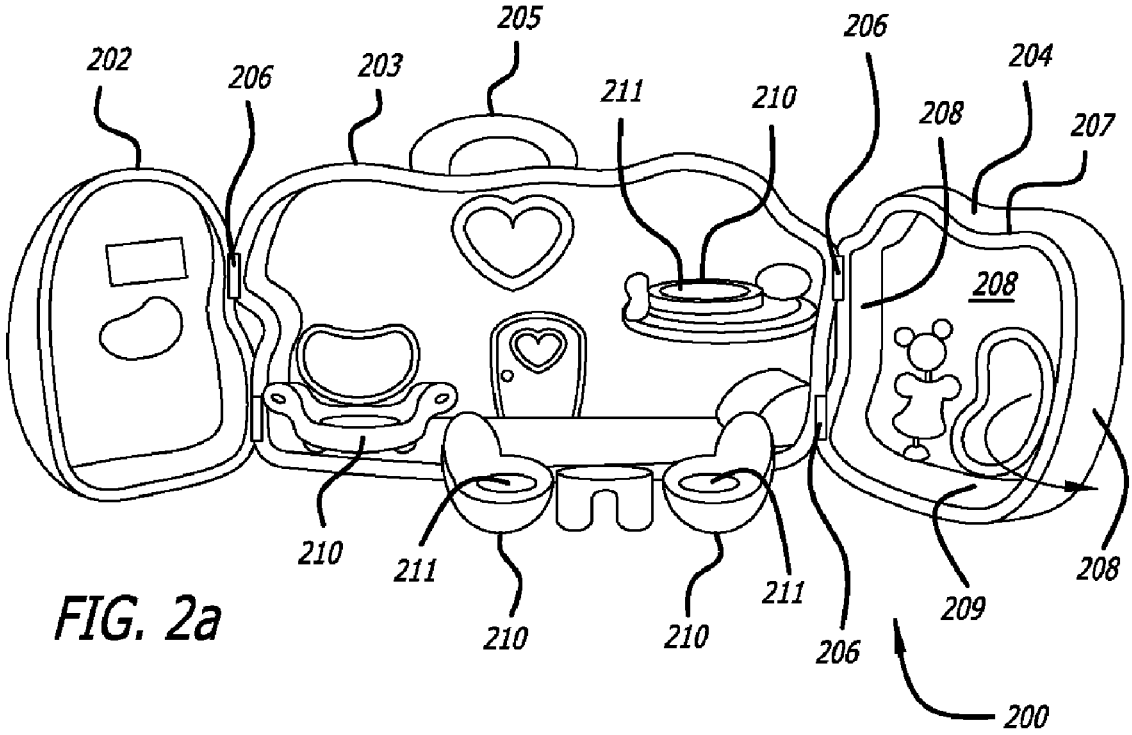

FIG. 2*a* illustrates a play set 200 in an open position and play set accessories. The play set 200 has three receptacles 202, 203, and 204. Each receptacle, 202, 203, and 204 has a floor 209, three walls 208, and a ceiling 207. Additionally, the second or middle receptacle 203 has a handle 205 attached thereto. The playset 200 can imitate the form of a playhouse, where the open view of the play set corresponds to the inside of the house and multiple components therein.

The play set 200 comprises a wall 208 of the first receptacle 202 that is connected to a wall 208 of the second or middle receptacle 203 by two hinges 206 and a wall 208 of the third receptacle 204 that is connected to a wall 208 of the middle receptacle 203 by the two hinges 206. Each receptacle 202, 203, and 204 is capable of containing various play set accessories 210 with recesses 211. Furthermore, the play set accessories 210 may or may not be affixed to the play set 200.

Figure 2B:
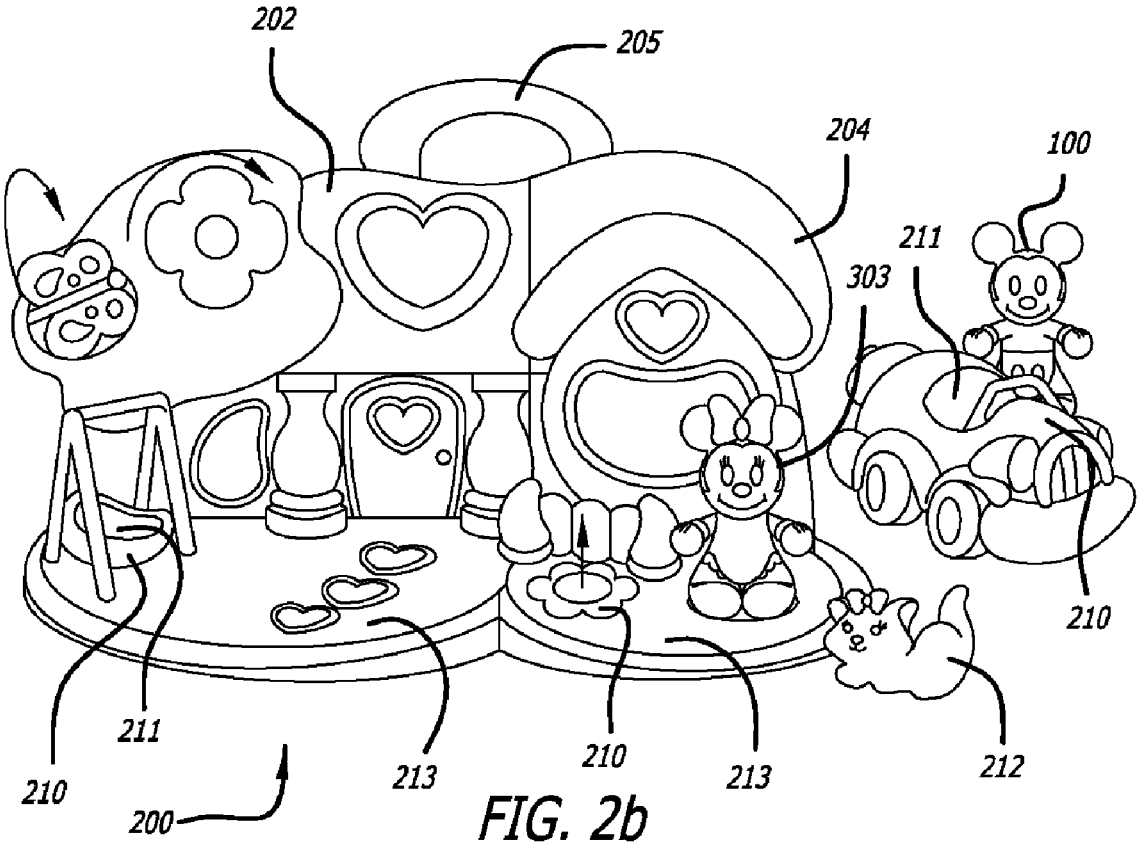
Figure 3A:
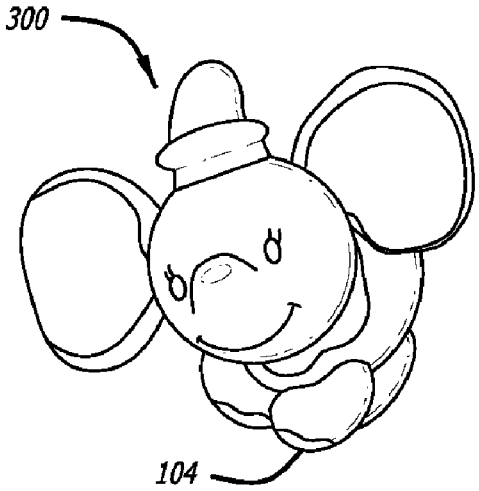
Figure 3B:
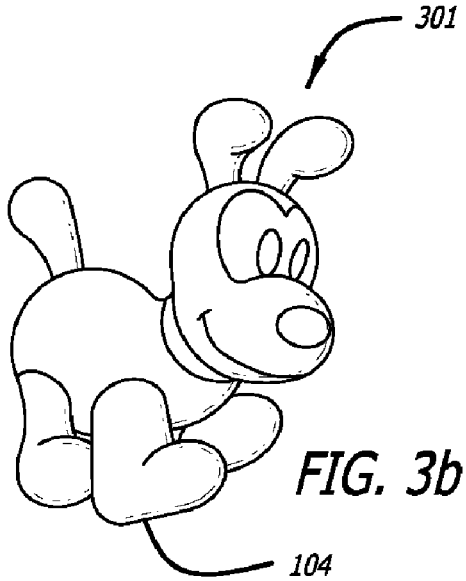
Figure 3C:
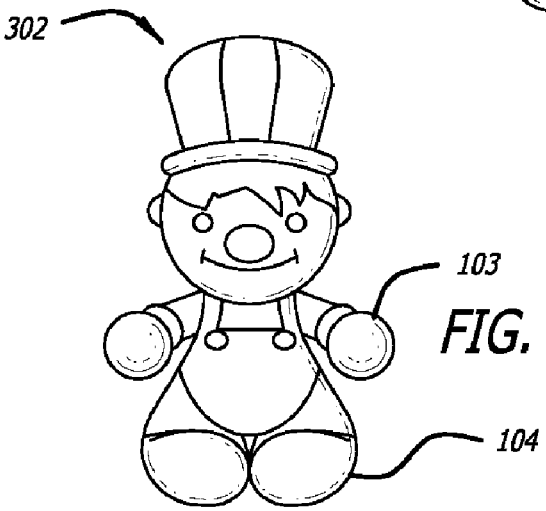
Figure 3D:
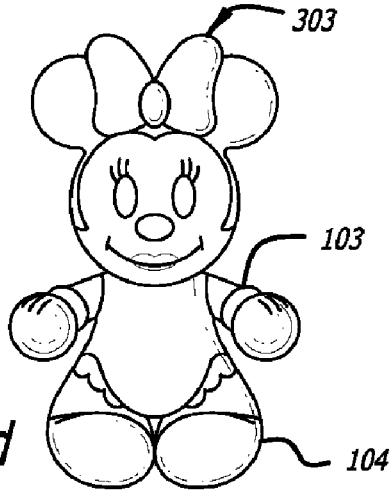
Figure 3E:
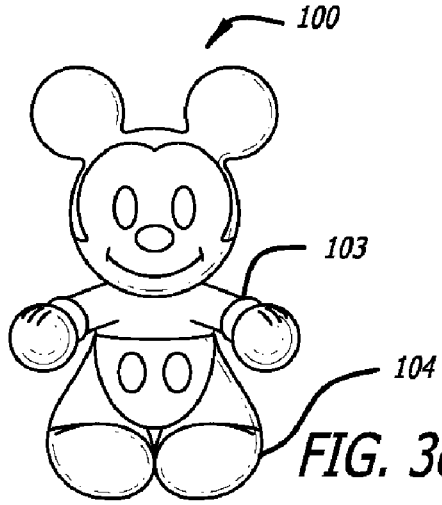

FIG. 2*b* illustrates a play set 200 in a closed position and play set accessories. In one embodiment, the outside of the first receptacle 202 and second receptacle 204 are shown as the outside of a playhouse. The outside of the receptacles 202 and 204 have connecting platforms 213 with surface areas for supporting a toy 303, or accessories 210, and/or geometrically-shaped recesses 211. The first receptacle 202 and second receptacle 204 are closed over the second or middle receptacle 202 (not shown) so that the three receptacles, 202, 203, and 204, form a case. For ease of carrying, the middle receptacle 203 may have a handle 205 attached thereto. Additionally, because the play set 200 forms an essentially hollow carrying case, the closed play set 200 may function as a carrying case for the toy figure 100 and/or play set accessories 210.

FIGS. 3*a*-3*e* illustrate toy figures of several embodiments. Each toy figure can have a different form or shape, or represent a different character. Such forms include, but are not limited to, a cartoon character, fictional character, person, animal, and/or creature. Toys 100, 300, 301, 302, and 303 illustrate different fictional characters. Toys 100, 302, and 303 have two articulating arms 103 and two articulating legs. Toys 300 and 301 have four articulating legs. In one example, toy 301 has four feet 104. Thus, each of the four feet 104 must be positioned to be planar to each other in order to form a level base portion.

Each of the toys 100, 300, 301, 302, and 303 can be placed in any recess shape on a play set. However, because each toy 100, 300, 301, 302, and 303 can be configured with a distinct base portion shape, each toy can correspond to a determined recess in a play set.

Figure 4:
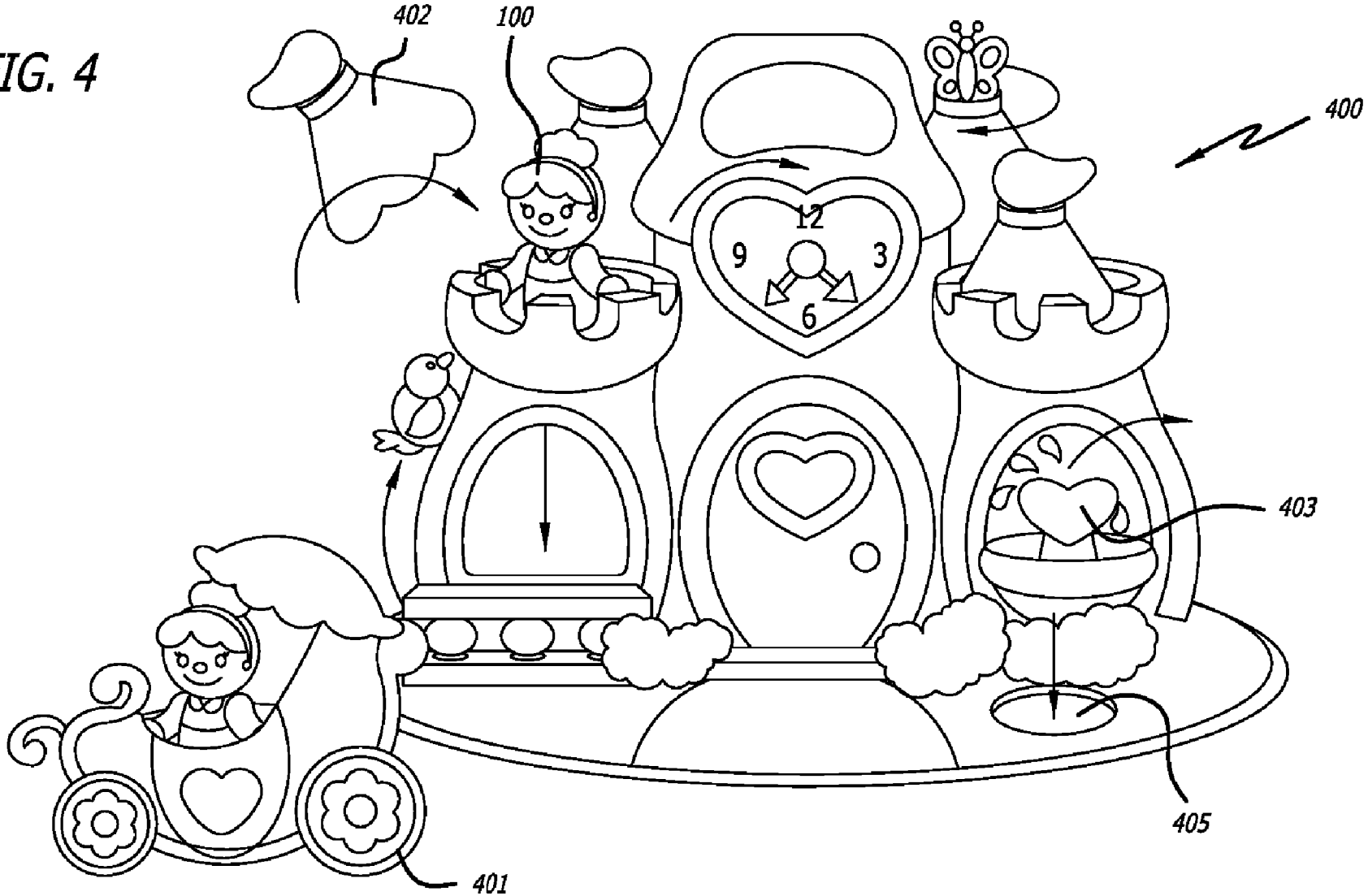
FIG. 4 illustrates a play set and play set accessories.

FIG. 4 illustrates a play set 400 and play set accessories 401. The toy figure 100, play set 400, and play set accessory 401 have the same corresponding theme or tone where the toy figure 100 is in the form of a fictional princess, the toy play set 400 is in the form of a castle, and the play set accessory 401 is in the form of a carriage vehicle. In this embodiment, various portions of the play set 400, such as the top of a tower 402 and ornament 403, are removable and/or movable.

Each of the toys in the play set can have a distinctly-shaped base portion that is compatible with a recess in the play set or play set accessory. Each distinctly-shaped base portion of the toy figure and recess can be essentially the same geometric shape. Thus, the base portion of the toy figure can be placed within a corresponding recess of a play set or play set accessory. Because the user must be able to match the toy figure's shape to a corresponding shape on a play set or play set accessory, the user is encouraged to participate in a shape-sorting activity and to learn and recognize different shapes.

Furthermore, a play set or play set accessory may have any combination of different geometrically-shaped recesses. Additionally, a play set or play set accessory may have any number of the same geometrically-shaped recesses.

In one embodiment, the base portions on all toys of the play set are circular. In another embodiment, the base portion of each toy has a distinct shape that differentiates the toy from the others. In yet another embodiment, the play set can have toys that are disposed in pairs, wherein each toy in a pair has the base portion shaped identically with the other toy in the pair.

For exemplary purposes only, a play set could have twelve total recesses with four play set accessories each having a recess, thus, a total of sixteen recesses. As stated earlier, any combination of shaped recesses is contemplated. Thus, of the sixteen total recesses, four could be rhomboidal, four could be heart-shaped, four could be circular and four could be square. Accordingly, there could be multiple toy figures each having a unique shape base portion. The toy figure will only correspond and fit into the recess with the same unique geometric shape. Thus, the user would configure the toy figures' base portion to match a corresponding shaped recess. This shape sorting and finding function permits the user to recognize and determine different shapes and sizes.

In another embodiment, the play set 400 includes three receptacles each having a floor, at least three walls and a ceiling, where the first receptacle is connected to a middle or second receptacle by at least one hinge and the third receptacle is connected to the middle or second receptacle by at least one hinge. The length and height of the first receptacle when combined with the length and height of the second receptacle essentially equals the length and height of the second or middle receptacle. Thus, when fully closed, the first and third receptacle fold over and cover the middle or second receptacle essentially forming a case. Alternatively, the three receptacles may be folded in a completely open position, where the three receptacles are in an essentially one-hundred-and-eighty-degree plane.

The receptacles in the play set 400 may have a ceiling forming an open room and one or more windows. Accordingly, embodiments where the receptacles have a floor, three walls, and a ceiling, form a hollow case when fully closed. In addition, the outside portion of the receptacle may be decorated or characterized as the outside of a building, structure, shop, store, house or room. Furthermore, the outside portion of a receptacle may extend beyond the receptacle acting as a platform. The platform is a surface area which may support one or more geometrically-shaped recesses, one or more toy figures and/or one or more play set accessories. The inside of the receptacles may be in the form of a specific room. Such specific rooms include, but are not limited to, a living room, bedroom, nursery, bathroom, garage, kitchen, or a typical room in a specific type of building, shop, structure, or store. Additionally, the play set may be in the form of a castle, train track, or outdoor scene.

In another embodiment, the form of the play set accessories will correspond to the overall theme, tone, or character of the play set. For example purposes only, a play set, which is in the form of a house or cottage, may have play set accessories in the form of furniture, appliances, clothing, or décor. Furthermore, the play set accessories may be a vehicle, piece of equipment, animal, and/or a simple surface area.

Figure 5:
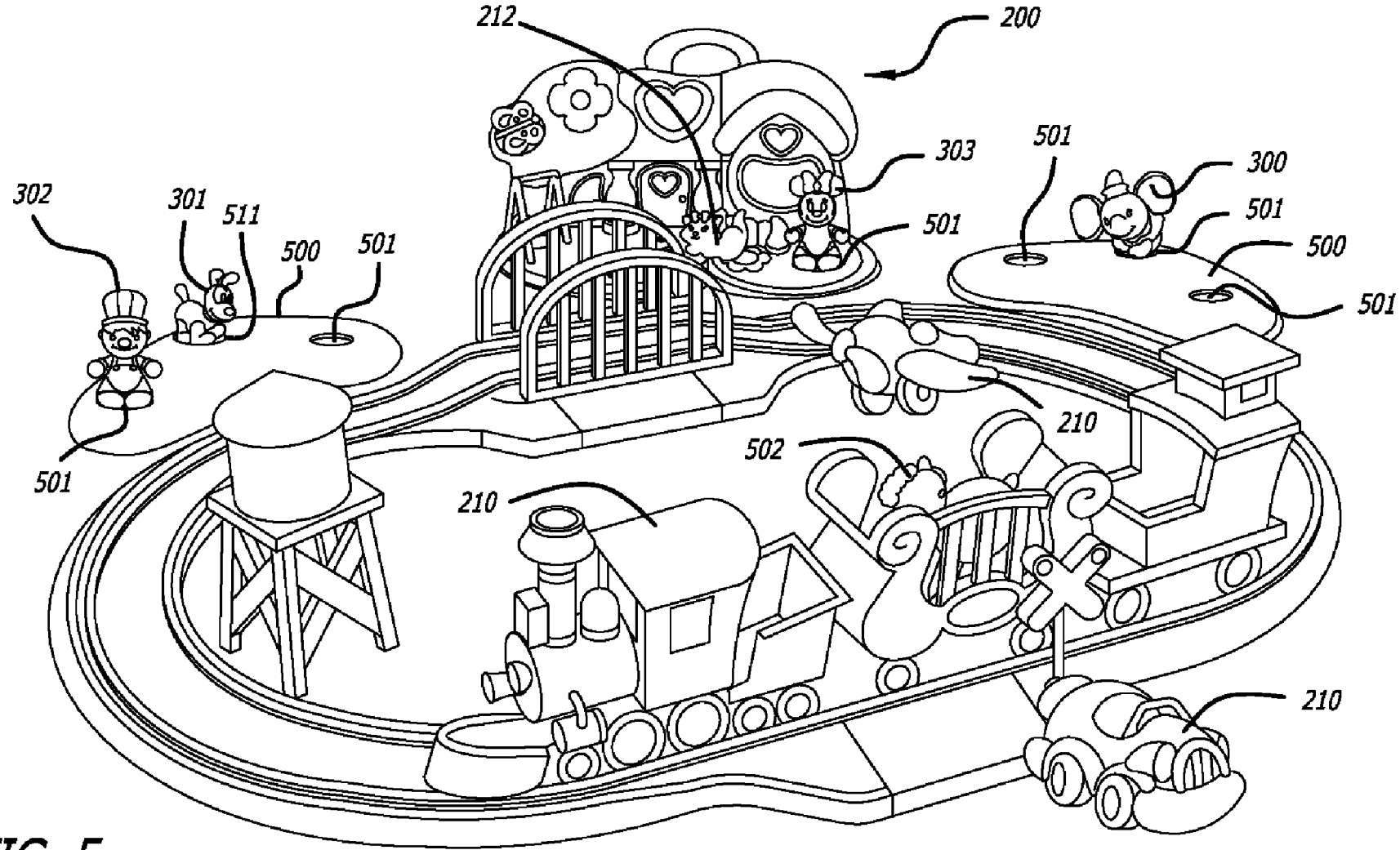
FIG. 5 illustrates an arrangement of play sets and play set accessories.

FIG. 5 illustrates an arrangement of play sets and play set accessories. Multiple toys 302, 301, 300, and 502, play sets 200 and 505, and play set accessories 500 and 210 are shown. The arrangement of play sets may include a play set 200 in a closed position in the form of a house or cottage, and two play set surface areas 500 with multiple geometrically-shaped recesses 501. A train track play set 505 with a corresponding train accessories 210 are also part of the play set and can have one or more recesses mounted on the train. Toy figures 302, 301, 212, 303, 300, and 502 have distinctly shaped bases that correspond to matching recesses 501. Additionally, several play set accessories 210 can be part of the play set.

While the apparatus and method have been described in terms of what are presently considered the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

What is claimed is:

1. A toy play set comprising:

a toy figure having:

a body portion including two or more articulated appendages, the two or more articulated appendages including one or more of arms, legs and a tail;

the two or more articulated appendages terminating in two or more distal ends to form a base portion when the two or more distal ends are positioned together; and a play set base having one or more distinctly shaped recesses therein;

wherein the base portion has a distinct shape permitting the base portion to be detachably coupled with a distinctly shaped recess in the play set base, wherein the distinctly shaped recess has a shape and size complementary to the distinct shape of the base portion formed from the two or more distal ends of the two or more articulated appendages of the toy figure.

2. The toy play set of claim 1, wherein the toy figure is in the form of a person, animal fictitious character, cartoon character or fictitious creature.

3. The toy play set of claim 1, wherein said distinct shape is a circle, an oval, a rectangle, a triangle, a star, a heart, a rhombus, a number, a letter, a common symbol, a mathematical operator, or a cartoon character.

4. The toy play set of claim 1, wherein the recess is disposed on the play set base or a play set accessory associated with the play set base.

5. The toy play set of claim 1, wherein the play set base has a plurality of recesses, each of the plurality of recesses being made of magnetic material such that the base portion and the plurality of recesses are magnetically attracted to each other.

6. The toy play set of claim 5, wherein the toy figure has a first articulated appendage and a second articulated appendage, the base portion being comprised of a first subcomponent and a second subcomponent, the first subcomponent being connected to a distal end of the first articulated appendage and the second subcomponent being connected to a distal end of the second articulated appendage;

wherein the base portion is formed into the distinct shape responsive to the first subcomponent being brought into proximity with the second subcomponent.

7. A toy figure comprising:

a body portion comprising a first articulated leg and a second articulated leg;

the first articulated leg having a first subcomponent at a distal end of the first articulated leg and the second articulated leg having a second subcomponent at a distal end of the second articulated leg, wherein the first subcomponent is a first part of a distinct shape and complements the second subcomponent which is a second part of the distinct shape, such that the first subcomponent and the second subcomponent, when positioned together, form a base portion having the distinct shape;

wherein the base portion, when formed by positioning the first subcomponent and the second subcomponent together, forms the distinct shape which is uniquely sized to be detachably coupled with a recess in a play set base having a shape and size complementary to the distinct shape of the base portion; and wherein when the base portion is not formed, detachable coupling of the base portion and the recess is precluded in as much as the distinct shape is not formed.

* * * * *